US010492649B2

(12) United States Patent
Kuboteit et al.

(10) Patent No.: US 10,492,649 B2
(45) Date of Patent: Dec. 3, 2019

(54) DOSING DEVICE WITH FLUID-SIDE MODULE AND A DRY MODULE

(71) Applicant: Bode Chemie GmbH, Hamburg (DE)

(72) Inventors: Stefan Kuboteit, Seevetal (DE); Stephen Oxley, Hamburg (DE); Christine Hegemann, Hamburg (DE); Christian Langlotz, Hamburg (DE)

(73) Assignee: Bode Chemie GmbH, Hamburg (DE)

( * ) Notice: Subject to any disclaimer, the term of this patent is extended or adjusted under 35 U.S.C. 154(b) by 0 days.

(21) Appl. No.: 15/738,656

(22) PCT Filed: Jun. 22, 2016

(86) PCT No.: PCT/EP2016/064409
§ 371 (c)(1),
(2) Date: Dec. 21, 2017

(87) PCT Pub. No.: WO2016/207211
PCT Pub. Date: Dec. 29, 2016

(65) Prior Publication Data

US 2018/0184856 A1 Jul. 5, 2018

(30) Foreign Application Priority Data

Jun. 26, 2015 (DE) ..... 10 2015 211 986

(51) Int. Cl.
*A47K 5/12* (2006.01)
*F04B 17/04* (2006.01)
(Continued)

(52) U.S. Cl.
CPC ..... *A47K 5/1207* (2013.01); *A47K 5/1204* (2013.01); *A47K 5/1217* (2013.01);
(Continued)

(58) Field of Classification Search
CPC ..... A47K 5/1207; A47K 5/1217; B05B 11/3004; B05B 11/3052; F04B 13/00; F04B 17/042; F04B 17/046; F04B 23/028
See application file for complete search history.

(56) References Cited

U.S. PATENT DOCUMENTS 3,348,489 A 10/1967 Meyer
4,102,610 A * 7/1978 Taboada ..... F04B 17/046 318/128
(Continued)

FOREIGN PATENT DOCUMENTS

DE 3132897 A1 3/1983
DE 4328621 A1 3/1995
(Continued)

OTHER PUBLICATIONS

International Search Report and Written Opinion from PCT/EP2016/064409 dated Sep. 6, 2016 with English Translation of International Search Report provided.

*Primary Examiner* — Frederick C Nicolas
(74) *Attorney, Agent, or Firm* — Dilworth & Barrese, LLP

(57) ABSTRACT

The invention relates to a dosing device comprises a fluid-side module (12,12') and a dry module (13), the fluid-side module (12,12') comprises a chamber (14) and a magnetic piston (16) which is drivingly moved into the chamber (14) by a magnetic drive, the piston is penetrated by a channel provided with a seal (20,56). The magnetic drive for the magnetic piston (16) is arranged in the dry module (13).

4 Claims, 12 Drawing Sheets

(51) Int. Cl.
*B05B 11/00* (2006.01)
*F04B 23/02* (2006.01)
*F04B 13/00* (2006.01)

(52) U.S. Cl.
CPC ..... *B05B 11/3004* (2013.01); *B05B 11/3052* (2013.01); *F04B 13/00* (2013.01); *F04B 17/042* (2013.01); *F04B 17/046* (2013.01); *F04B 23/028* (2013.01)

(56) References Cited

U.S. PATENT DOCUMENTS 4,518,105 A * 5/1985 Kuckens ..... G01F 11/082 222/207
5,472,323 A * 12/1995 Hirabayashi ..... F04B 17/046 310/35
5,567,131 A * 10/1996 McNaull ..... F04B 17/046 137/539
5,988,440 A 11/1999 Saunders et al.
6,209,751 B1 4/2001 Goodin et al.
7,093,774 B2 * 8/2006 Martin ..... H05H 1/22 222/255
7,578,419 B2 * 8/2009 Greenwald ..... B67D 1/0079 222/333
7,896,202 B2 * 3/2011 Greenwald ..... A47K 5/1207 222/333
8,201,587 B2 * 6/2012 Bonner ..... F04B 9/14 141/291
9,186,666 B2 11/2015 Hofstetter et al.
2004/0031821 A1 * 2/2004 Lasry ..... B05B 11/0032 222/470
2009/0236440 A1 9/2009 Anderson et al.
2009/0266849 A1 10/2009 Greenwald et al.
2011/0253237 A1 10/2011 Sworske et al.

FOREIGN PATENT DOCUMENTS

DE 69620430 T2 10/2002
DE 10201000690 A1 7/2011
EP 0605903 A1 7/1994

* cited by examiner

DOSING DEVICE WITH FLUID-SIDE MODULE AND A DRY MODULE

This application claims priority to German Application No. 102015211986.6 filed on Jun. 26, 2015.

The invention relates to a dosing device (pump) having a fluid-side module and a dry module separate herefrom, wherein the fluid-side module comprises a chamber and a magnetic piston which is guided in the chamber and is movable by means of a magnetic drive, said piston being penetrated by a duct provided with a seal.

Dosing devices are widely known in the prior art. Thus they are used, for example, in dispenser systems for liquids, for example of alcoholic liquids, which are intended to be released in prespecified quantity upon demand, for example for hand disinfectants. In these cases, the term "volume on demand" is used. Thus dispenser systems of this type for hand disinfection generally have a, for example, wall-mounted, fixed holder, which has a drive, and wherein the holder can be provided with exchangeable disinfectant bottles and which can be complemented with a reusable or a disposable pump. In standard dispenser systems for hand disinfectants, it is here frequently the case that these are prone to faults which arise through contact with the alcoholic products (fluids). In particular, pump diaphragms and seals can swell or release softeners, resulting in leaks or fluctuations in respect of the delivered volume. Furthermore, the provided mechanical components are prone to wear.

Below, the terms "dispenser" and "dispenser system" are employed synonymously, wherein dispenser systems are either wall-mountable or can be fixed on other surfaces, or can be free-standable as standing bottles. By the term "dosing device" should be understood a device which enables a substantially reproducibly deliverable quantity of a fluid to be provided on demand, wherein the dosing device has a dosing module, here the dry module comprising a drive, as well as a fluid-side module or pump module. The dosing device can here be part of a dispenser or dispenser system and be integrated therein. Depending on the design of the dispenser system, the dosing device can also already constitute a complete dispenser system provided that no further components, such as holders or similar, are added.

Moreover, EP 1 824 760 B1 discloses a dispensing device for air improvers, having a material container and a delivery apparatus containing an electromagnetic closure mechanism in which a first part is attached to the container and a second part to the delivery apparatus.

Furthermore, a pump for the conveyance of liquids is known, for instance, from DE 31 32 897, wherein a piston is moved back and forth between two magnetic fields generated by means of two coils. The piston here has a longitudinal bore and a nonreturn valve, wherein it is here in particular a case of a fuel pump. The coils enclose the piston and are arranged with the latter within the housing and within the part acted upon by liquid.

Finally, an electromagnetically operable pump is known from DE 43 28 621 A1. The delivery rate per stroke should vary only slightly from a prespecified delivery rate, since the creation of underpressure is avoided by means of a pressure accumulator.

Starting from the known prior art, it should now be an object of the invention to provide a dosing device having a fluid-side module and a dry module, which is as resistant as possible to mechanical wear.

A further object, insofar as alcoholic liquids, as are standardly employed in hand disinfection, are intended to be provided with the dosing device, is that the dosing device is capable of meeting the requirements also with regard to the conveyance of alcoholic liquids.

The invention achieves this object through the provision of a dosing device having the features of claim 1, in which the magnetic drive for the magnetic piston is disposed in the dry module. In this way, it can be achieved that as few parts of the dosing device as possible come into contact with the fluids and thus have to be appropriately equipped against corrosion and wear. Moreover, through the use of a magnetic drive, the mechanical wear can be lowered. Between the two parts, namely the magnetic piston in the fluid-side module (product-touching parts) and the magnetic drive in the dry module, there is no non-positive connection. The wear on the drive is thereby heavily reduced. Above all, an appropriate dosing device consists of simple components.

It can here be provided that the chamber has an inlet on a side lying in the motional direction of the piston and an outlet on an opposite side, and wherein the inlet is connectable to a fluid reservoir, and the outlet to a dispensing device. It can in particular be provided that the chamber is a cylindrical chamber, though other cross sections are also conceivable. On the two end faces, respectively inlets and outlets can in this case be provided, wherein inlet and outlet are preferably arranged centrally on the respective end faces.

In particular, in a dosing device as is used for hand disinfection, it can be provided that the chamber is configured as a riser tube, i.e. that a conveyance of the fluid, in the installed state, takes place from the bottom up. The piston here moves between inlet and outlet in the axial direction of the preferably cylindrical chamber. Alternatively, arrangements in a so-called overhead system can also however be provided, wherein the outlet is arranged at the bottom in the usage state and the fluid flow runs from top to bottom.

Moreover, besides these two preferred variants, a tilted construction, through to the horizontal arrangement of the cylinder in the installed state, is also conceivable. In particular it can here be advantageous, for example, to arrange, the container into which the fluid-side module is fitted, together with the fluid-side module, such that all liquid can be removed from the fluid reservoir and thus a complete emptying capability is given. For this, an inclined or tilted arrangement can be sensible. Insofar as a complete emptying capability of the fluid reservoir is important, it can also be provided that the inlet of the chamber is connected to a feed line, which is arranged in such a way and, in particular, also has such a curvature that it ensures, or is capable of rendering in an improved manner, a complete emptying capability.

The fluid reservoir can be constituted by commercially available fluid reservoirs, as can be used, for instance, as disinfectant bottles for commercially available hand disinfection devices. In particular, dosing devices according to the invention can be employed or be retrofittable in otherwise, in terms of design, commercially provided dispenser systems for hand disinfection.

The fluid reservoirs and/or the fluid-side modules can be disposable and, in particular, exchangeable. Alternatively, they can be treatable, and thus reusable.

As the fluids to be conveyed, in particular hand disinfectants, but also further products from the field of disinfectants, as well as from body care or personal hygiene, can be employed. Thus, the conveyance of shower gels, soaps, creams, but also cleaning liquids, is conceivable. By fluids should here be generally understood liquids of different viscosities, in particular including aqueous liquids, gels and pasty substances. Within the meaning of the invention, gases should not however be subsumed under the term "fluid".

Besides the direct delivery of the fluids and the direct use of these same, it is also possible for such fluids to be employed to produce a ready-to-use mixture, the fluids being in the form of concentrates, which then for instance, with a further fluid, produce a usable solution.

That is to say that the dosing device can also be used to convey substances which are then diluted by other fluids and can then be provided, together with these fluids, as a usable solution via a further system.

Particularly preferredly, it can be provided that the dry module can be reusable and can be connected to a fixed holder and/or fluid reservoir. In this case, the dry module, in accordance with the standards pertaining to hand disinfection, insofar as it is used there, can be employed with exchangeable fluid reservoirs, since the dry module has no contact with fluid.

By reusable should here be understood that the dry or the fluid-side module or the fluid reservoir can be employed with several successive fillings of the fluid reservoir with fluid.

Alternatively but not preferredly, the dry module can also be connectable to a fixed holder or the fluid reservoir (liquid reservoir), and jointly with the fluid reservoir or, for example, when a fluid reservoir is changed, or at some other (in particular prespecified) time, can be discarded.

It can here be provided that a seal is provided in, in the duct of the piston in order to enable the discharge of liquids in defined quantity, wherein the seal, during the discharge process of fluids, is closed, and afterward, upon a return of the piston into the starting position, is opened to enable an afterflow of fluids.

Moreover, it can also be provided that the inlet opening can be closed off by means of a seal, in particular a valve seal, against the backflow of fluids. This is sensible, in particular where the direction of conveyance is from the bottom up. The seal in the duct of the piston can likewise be realized as a valve seal.

Valves of this type are made of inert materials, such as, for instance, glass, polyethylene or special steel, wherein alternatively a seal made of a plastics material (elastomer/silicone) can be provided. In particular, as the seal a ball valve can be provided, wherein the ball can be made, for instance, of glass, ceramic or metal, and the ball trap of a material, for instance a polymer, which is inert toward solvents. Instead of a ball, a different geometric shape of preferably round cross section (transversely to the motional direction of the piston), such as, for instance, a cone, can also be employed. Alternatively, the seal can also be a diaphragm and consist of a flexible inert material, for instance silicone, wherein the diaphragm is movable between a flat and a folded form (screen principle), depending on whether the valve is open or closed. The valves here open and close automatically given appropriate conditions in the chamber.

Insofar as the outlet opening, in the installed state, is provided at the bottom, a sealing mechanism can be provided at the outlet opening, instead of or in addition to a seal or a valve at the inlet, in order thus to provide a sealing against leakage.

The magnetic drive can here be variously configured according to the intended use. It can thus be provided that one or more electromagnets are provided, wherein ring magnets and horseshoe magnets, but also single magnets, can be provided, which magnets, when actuated, trigger a movement of the piston in the desired direction. In addition, a plurality of electromagnets arranged one above another in the motional direction of the piston can also be provided, which electromagnets are actuable for the movement of the piston and thus raise the piston.

Where a plurality of magnets arranged one above another are provided, a mutually different piston stroke can be achieved according to the actuation. Thus, insofar as a plurality of electromagnets arranged one above another in the motional direction of the piston are provided, it can be provided that the magnets are activated from the bottom up in the case of a vertically upward motional direction of the piston, from a starting position (at the bottom) into a position for the discharge of liquid (at the top), and are subsequently either switched off, so that the piston gets to be lowered by gravitational force, or the piston is moved from top to bottom back into the starting position by activation of the magnets. This can be advantageous in particular in the case of higher viscosity liquids, so that an energy store in the form of a spring can be dispensed with. Depending on which magnets are actuated, the discharged volume can be dosed. If, for example, a plurality of magnets are arranged correspondingly at a predefined distance apart, then the difference can respectively amount to, for instance, 0.5 ml discharge quantity, i.e. for each actuated row of magnets, this quantity is dispensed. In this way, the applied volumes can be incrementally altered and controlled in a predefined manner. The application is then realized in a single discharge of liquid. In the case of a liquid delivery from top to bottom, the actuation is realized analogously. The dosing device is in particular suitable for conducting on demand an exact dosage of 1.5 ml or 3.0 ml of an alcoholic hand disinfectant, as is prescribed for hygienic or surgical hand disinfection (Hygienic Hand Disinfection: EN 1500. Surgical Hand Disinfection: EN 12791)

Preferably the dosing device here serves for the conveyance of hand disinfectants, and also of further fluids from the field of body care, personal hygiene and body disinfection and is employed herein. Moreover, the dosing device is particularly suitable for the delivery of liquids which are employed on the skin. Appropriate liquids are stated above. In particular, it is here a case of skin or hand disinfection liquids. The application is here realized such that the liquid is delivered from the closed dosing device or dispenser system, for instance into the hand of a user, for example a healthcare professional or similar. By this user, the liquid is then distributed, for example, on the hand. Alternatively, it is also conceivable that, via the dosing device, a predefined quantity is delivered into a further system, which can be open or closed, so as then in this further system to mix two liquids for the creation of dilutions.

Alternatively, the actuation can also be realized such that several applications are carried out in direct succession in order to obtain a pulsed delivery.

The drive is here realized magnetically through induction of a magnetic field by means of electromagnets. Alternatively or additionally, a displacement of a magnetic field can also be realized by means of electromagnets or permanent magnets.

The triggering which is realized by the actuation of the magnets can be done contactlessly, for example by means of a photocell, a light barrier or other, for example capacitive, systems. Alternatively, a contact-induced triggering (by touch), in known manner via a switch, a lever or similar, is also conceivable.

Moreover, it is also conceivable to displace the outer magnet by a linear drive. That is to say that the magnetic drive which is provided in the dry module comprises permanent magnets, which are linearly displaceable in the motional direction of the piston. By the magnetic field, the ferromagnetic piston is then transported in linear displacement in both directions. Alternatively or additionally, the outer magnetic drive can also be fixed and the chamber or the entire fluid-side module is moved. Thus, it is conceivable, for instance, that the fluid-side module, together with the fluid reservoir, is moved. Alternatively, merely the fluid-side module can also be moved and, at the same time, the fluid reservoir is immovably held. In this case, it can be provided that a flexible connection can be provided between the fluid-side module and the fluid reservoir, for example via silicone tubes. The drive can here be realized electrically, in which case the power supply can be provided by means of a battery, via a solar cell, but also via a central power supply which can be provided via a fixed dispenser (holder). In the same way, the power supply for the electromagnetic drive (electromagnets) can also be realized.

Besides the provision of an electrically actuated linear drive for the magnetic drive, a mechanical drive for the outer magnet can also be provided, in that the latter is moved up and down via a lever mechanism and a resetting is realized, if need be with a spring. The mechanical drive can also be supplemented with an electric or electromechanical drive. The spring has in this case no contact whatsoever with the fluid. Analogously to that which has been described above, the outer magnetic drive can also be locally fixed, and the chamber or the fluid-side model can be moved linearly up and down either together with the fluid reservoir or independently therefrom, wherein here too, if need be, a spring can be provided for the resetting.

Further advantages and features of the invention emerge in isolation, or in any chosen combination with one another, from the description, and from the following presentation of the illustrative embodiments and the claims.

The invention shall be described in greater detail below on the basis of illustrative embodiments, wherein:

DETAILED DESCRIPTION OF THE DRAWINGS

Figure 1:
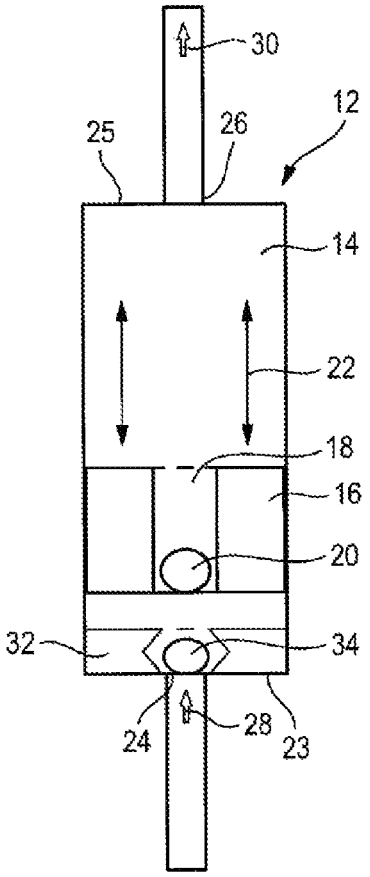
FIG. 1 shows a fluid-side module of a dosing device according to the invention in a first embodiment.

FIG. 1 shows a fluid-side module of a dosing device according to the invention, which in its entirety is provided with the reference symbol 12. The fluid-side module comprises a chamber 14, in which a piston 16 made of a ferromagnetic material is movably guided. The chamber 14, and also the piston 16, preferably have a cylindrical cross section. The piston 16 is provided in the middle with a duct 18, wherein in the duct 18 is arranged a ball valve 20 as the seal. The piston 16 can here be moved back and forth in the chamber 14 in the arrow direction 22. In addition, the chamber has on one end face 23 an inlet 24 and on the opposite end face 25 an outlet 26. The inlet 24 is here connectable to a fluid reservoir (not shown), and the arrow 28 shows the fluid flow from the fluid reservoir (not shown) into the chamber 14. The outlet 26 can here be connected to a fluid dispensing device, which likewise is not represented, and this fluid flow is labeled with the reference symbol 30. In the provided arrangement, a liquid flow is realized from the bottom up (upright), as is often provided in hand disinfection devices having a holder which is fitted, for instance, fixedly to a wall, and wherein the liquid-side module 12 is connected to the fixed holder and also to the fluid reservoir.

Furthermore a seal 32 is provided at the inlet 24, which seal likewise has a ball valve 34. As the ball material, glass or ceramic or a metal can, for instance, be employed, wherein the ball material must be resistant to the employed, in particular alcoholic, fluid, as is used for hand disinfection. The ball trap here likewise consists of a material which is inert toward solvents or the used fluid and is preferably made of a polymer.

As a result of the up and down movement of the piston 16 in the chamber 14, fluid is conveyed according to the arrow directions 28, 22 and 30 from a fluid reservoir to a dispensing device. If the piston moves from a lower position in an upward direction in the drawing, the ball seal 20 ends up in the shown position, and liquid from the region above the piston 16, which liquid is contained in the chamber 14, is delivered via the outlet 26. The chamber 14 is here constructed in the style of a riser tube. At the same time the valve 34 opens, so that fluid can further flow out of the reservoir into the region of the chamber 14 beneath the piston 16.

If then, after the fluid delivery, the piston 16 is guided downward, or falls downward due to gravity, then the ball 20 is lifted off its represented seat and frees an opening via which fluid is then conveyed from the region beneath the piston 16, in the arrow direction 28, through the duct 18 into the region above the piston 16. The valve 34 is here closed.

Figure 2:
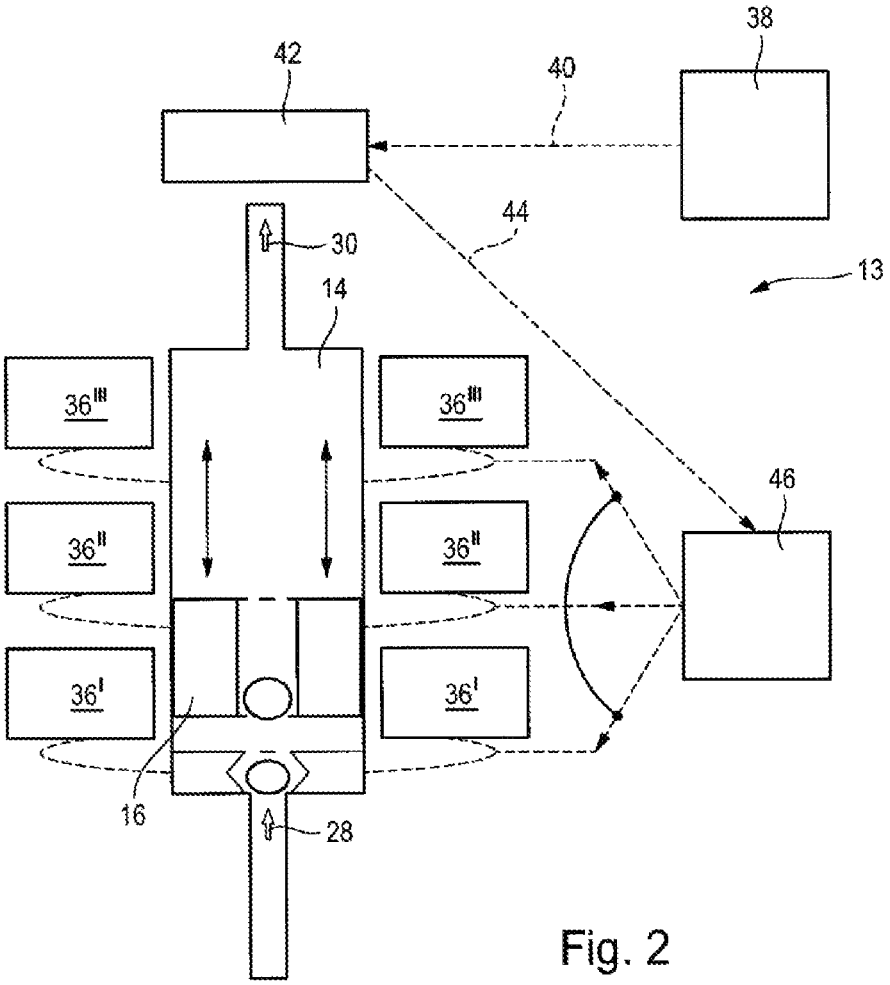
FIG. 2 shows a dosing device according to the embodiment according to FIG. 1.

The actuation of the piston 16 is now shown in FIG. 2, which, with respect to the fluid-side module, corresponds to the embodiment according to FIG. 1, and likewise shows the dry module 13.

The dosing device here has a dry module 13, which has no contact whatsoever with the fluid and possesses a plurality of electromagnets 36 arranged one above another in the motional direction of the piston 16. These can be configured as single magnets, but also as ring magnets or horseshoe magnets. If now, via a power source 38, a current is applied to a switch or sensor 42, then this can be actuated, either contactlessly or via a touch, and according to the setting gives a signal 44 to a control system 46, which latter actuates the electromagnets 36'-36''', to be precise such that the piston 16 is raised vertically upward in the chamber 14 in the arrow direction 28, 30 and a conveyance of a previously defined fluid quantity ensues, which fluid quantity then passes out of an outlet of a dispensing device.

After this delivery of fluid, the piston 16 then falls back again into its starting position, either by means of gravity, or in controlled manner via the electromagnets 36. The fluid delivery can here be controlled such that, for each row of electromagnets 36' to 36''', 0.5 ml/1.0 ml fluid are dispensed in a jet, maximally, therefore, 1.5 ml/3.0 ml fluid.

It is here particularly advantageous that no mechanical components, and thus components subject to increased wear, are necessary, and, in particular, no non-positive or otherwise mechanical coupling between the fluid-side module 12 and the dry module 13 is necessary for the driving of the piston 16.

Figure 3:
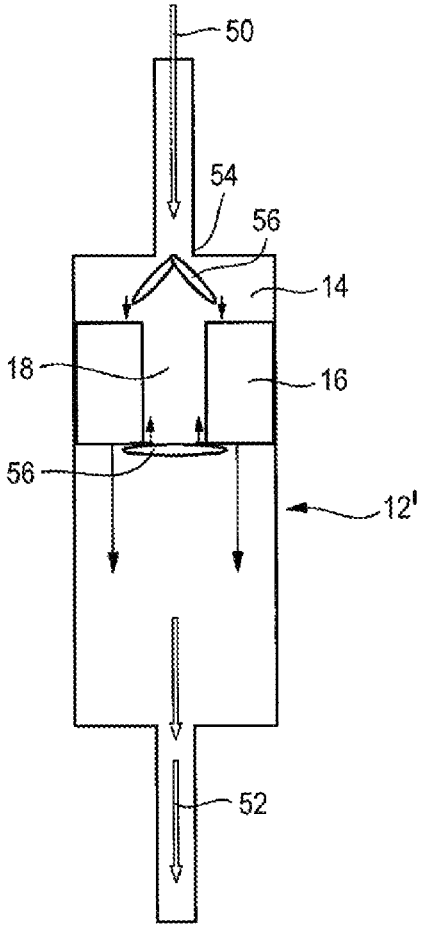
FIG. 3 shows an alternative embodiment to FIG. 1.
Figure 4:
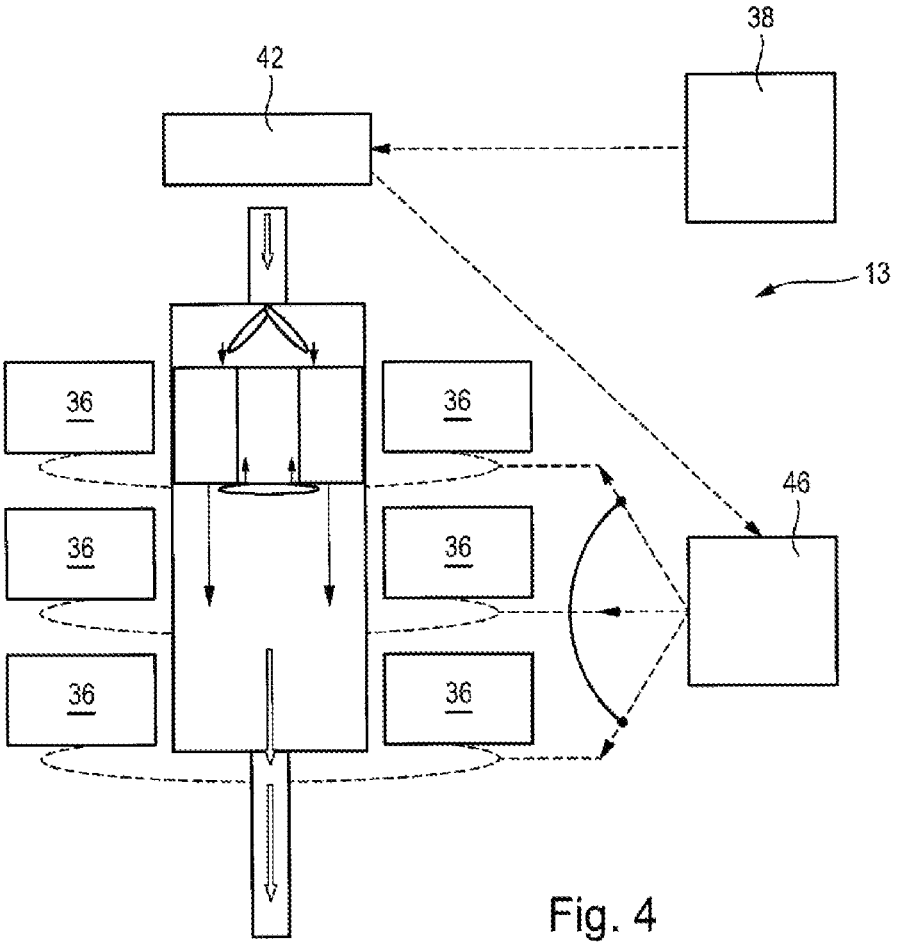
FIG. 4 shows a dosing device according to an embodiment to FIG. 3.

FIGS. 3 and 4 now show an alternative embodiment, wherein a liquid flow in the representation of the drawing, and also in a subsequently occurring installation situation, is realized from top to bottom, thus "upside down". The fluid flow is here labeled with the reference symbols 50 and 52. In the chamber 14 is in turn provided a piston 16 made of a ferromagnetic material. Unlike the previous illustrative embodiment, the fluid inlet 54, as well as the duct 18 in the piston 16, are provided with a diaphragm seal 56 which functions according to the screen principle, wherein the open setting can be seen at the fluid inlet 54, and the closed position of the diaphragm seal 56 at the duct 18. The shown position of the seals represents the position which is adopted during the discharge and secondary conveyance of liquid through the diaphragm seals 56.

If the piston 16 is then moved back again from a position at its, in the plane of the drawing, lower position, the diaphragms 56 adopt exactly the opposite positions and thus seal off the entrance, and at the same time convey fluid into the region beneath the piston 16, thus into that region of the chamber 14 which is facing the exit-side end of the piston 16.

The choice of seal (for example ball valve or diaphragm seal) can be made independently of the direction of flow of the fluid.

FIG. 4 now shows the associated arrangement of the dry module 13 corresponding to the arrangement according to FIG. 2, wherein the magnets 36 are actuated such that a conveyance takes place from top to bottom.

Figure 5:
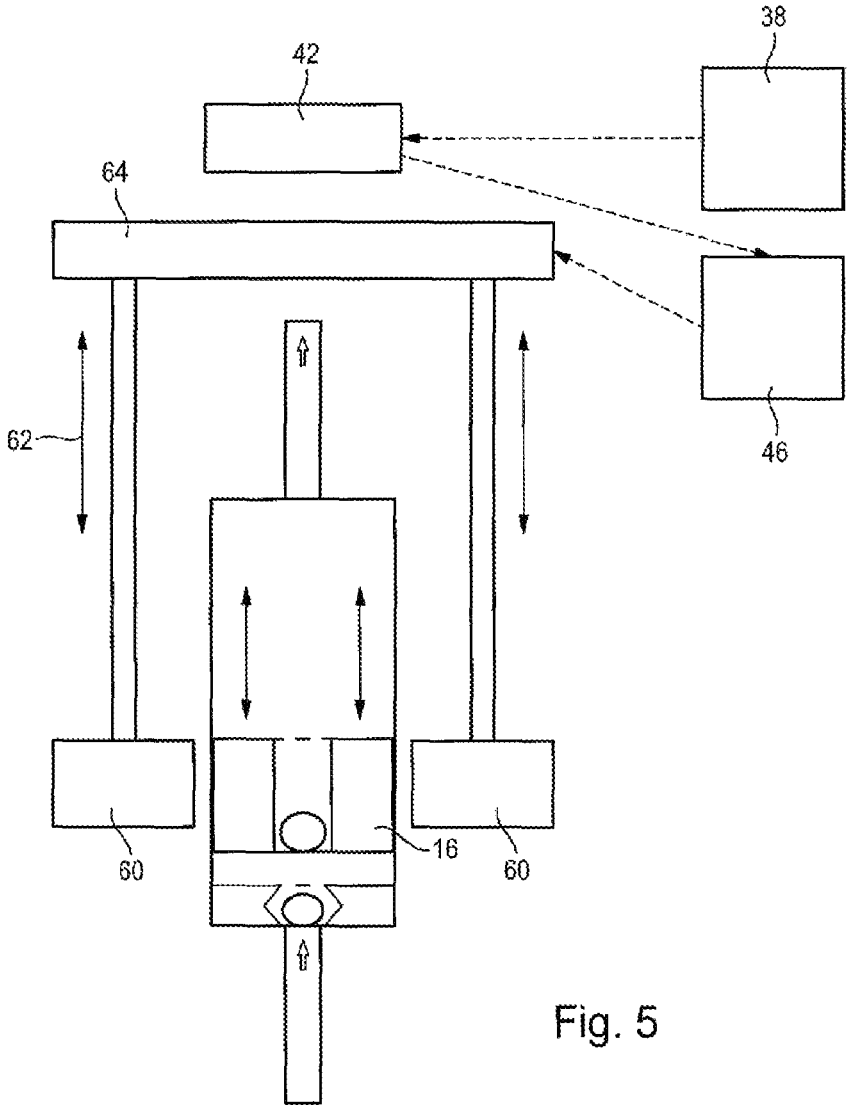
FIG. 5 shows a further alternative, in which the magnetic drive of the dry module is moved.
Figure 6:
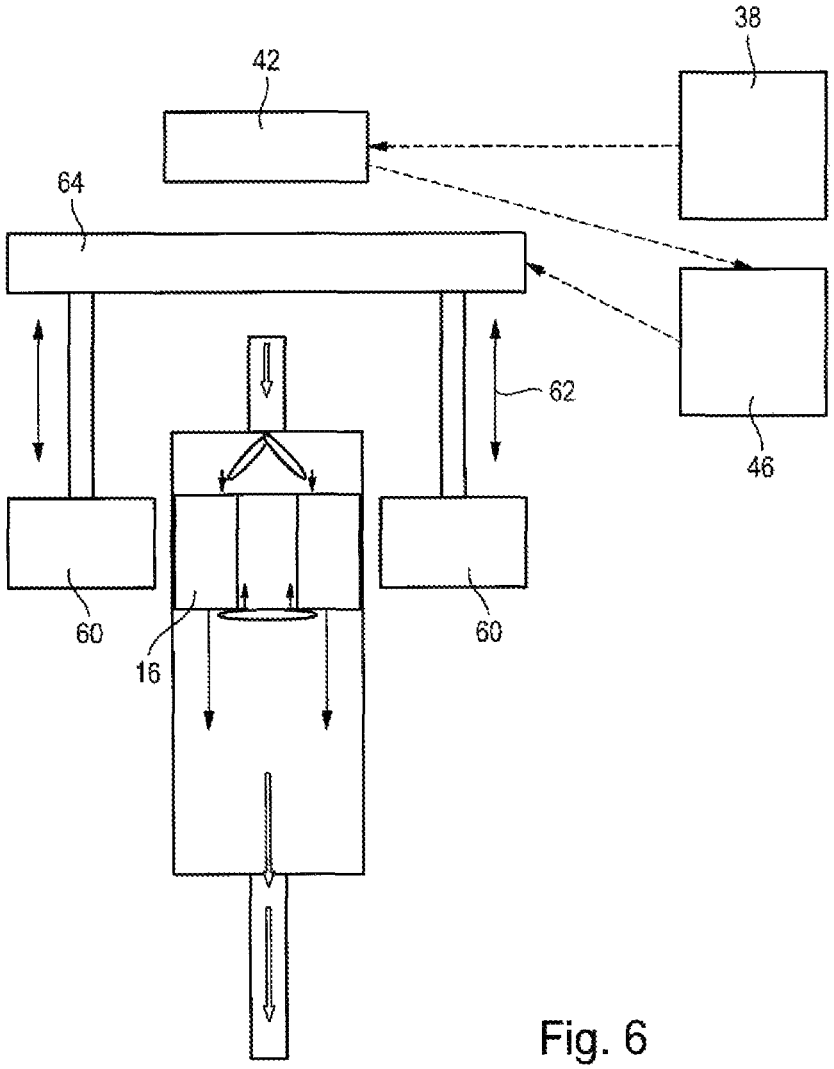
FIG. 6 shows an alternative embodiment to FIG. 5.

FIGS. 5 and 6 show alternative options of the magnetic drive in the dry module 13, wherein, a plurality of electromagnets 36 arranged one above another in the motional direction of the piston 16 are not, as in FIGS. 1 to 4, provided for the actuation, but rather the magnets of the magnetic drive are configured as permanent magnets 60, which respectively interact with the ferromagnetic material of the piston 16, and the movement of the piston is realized by virtue of the fact that the magnets 60 are moved linearly in the direction of the double arrows 62 by means of an electromechanical drive 64 for the permanent magnets 60. The arrangement comprising power source 38, switch or sensor 42 and control system 46, which latter actuates the electromechanical drive for the permanent magnets 64, corresponds to that which has already been shown in the preceding figures.

FIG. 5 here shows an embodiment having a fluid-side module according to FIG. 1, and FIG. 6 an embodiment having a fluid-side module according to FIG. 3, wherein here a conveyance takes place from top to bottom, and in FIG. 5 from the bottom up.

Figure 7:
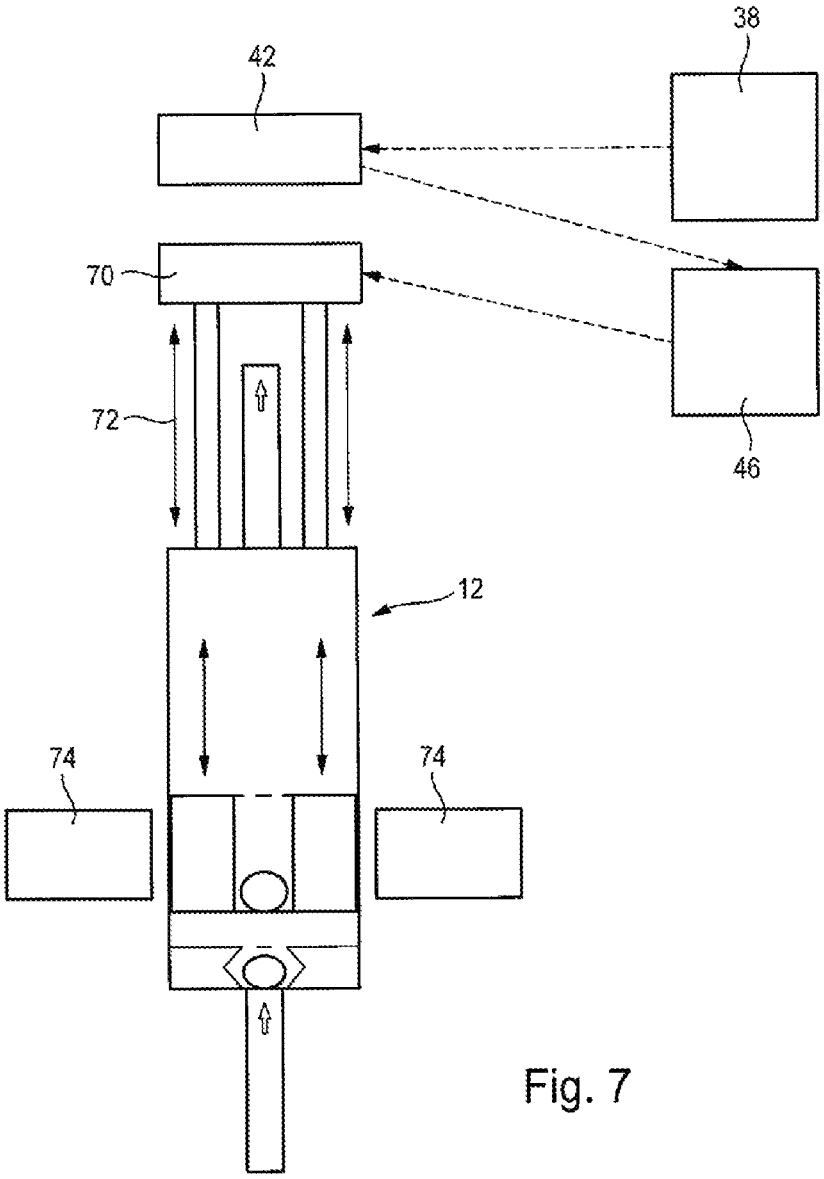
FIG. 7 shows an embodiment in which the fluid-side module is moved.
Figure 8:
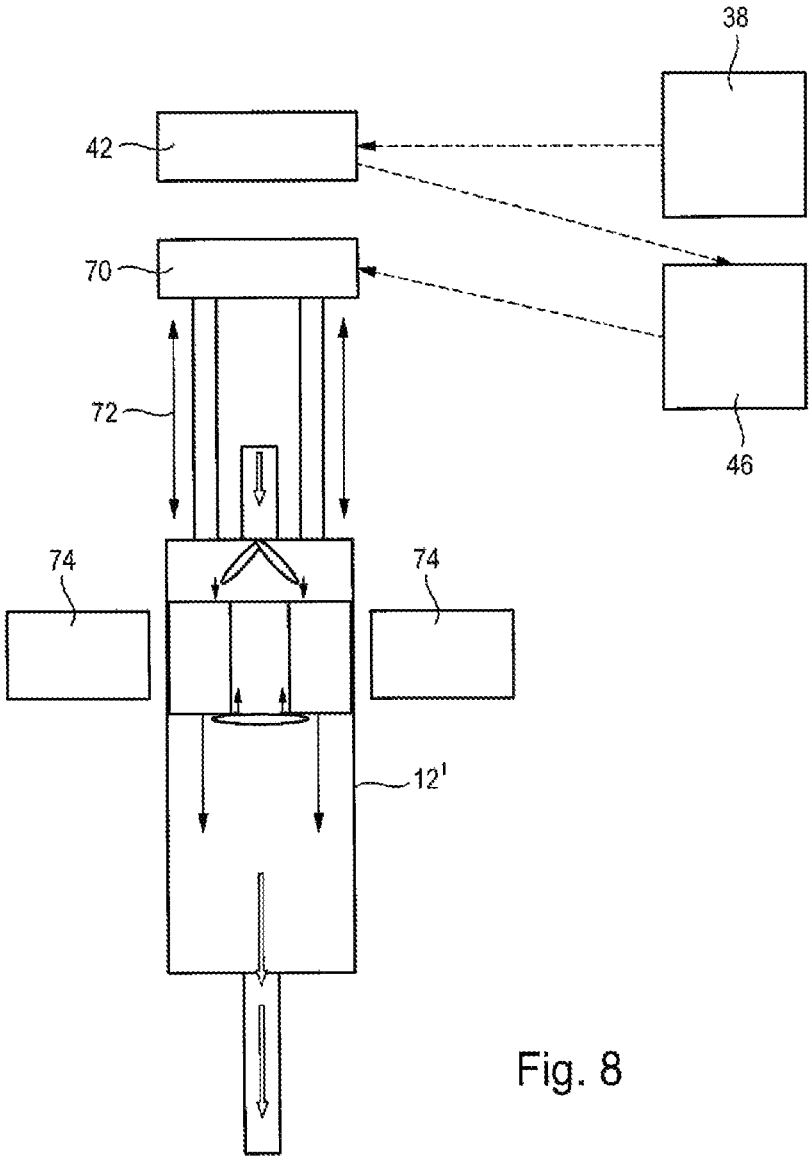
FIG. 8 shows an alternative embodiment to FIG. 7.

FIGS. 7 and 8 show a further alternative embodiment, wherein the fluid-side module 12 according to FIG. 7 corresponds to that described with respect to FIG. 1 and the fluid-side module 12' corresponds to that described with respect to FIG. 3, so that these shall respectively not be discussed in greater detail. Likewise provided is a power source 38, which is connected to a switch or sensor 42 that can be actuated by touch or contactlessly and in turn interacts with a control system 46 which here controls an electromechanical drive for the fluid-side module 12 or 12'. The electromechanical drive for the fluid-side module is provided with the reference symbol 70. The fluid-side module 12, 12' is then moved in the direction of the double arrows 72, wherein the permanent magnets 74 are immovably held and the piston 16 too is hereby secured, while the chamber 14 moves.

Figure 9A:
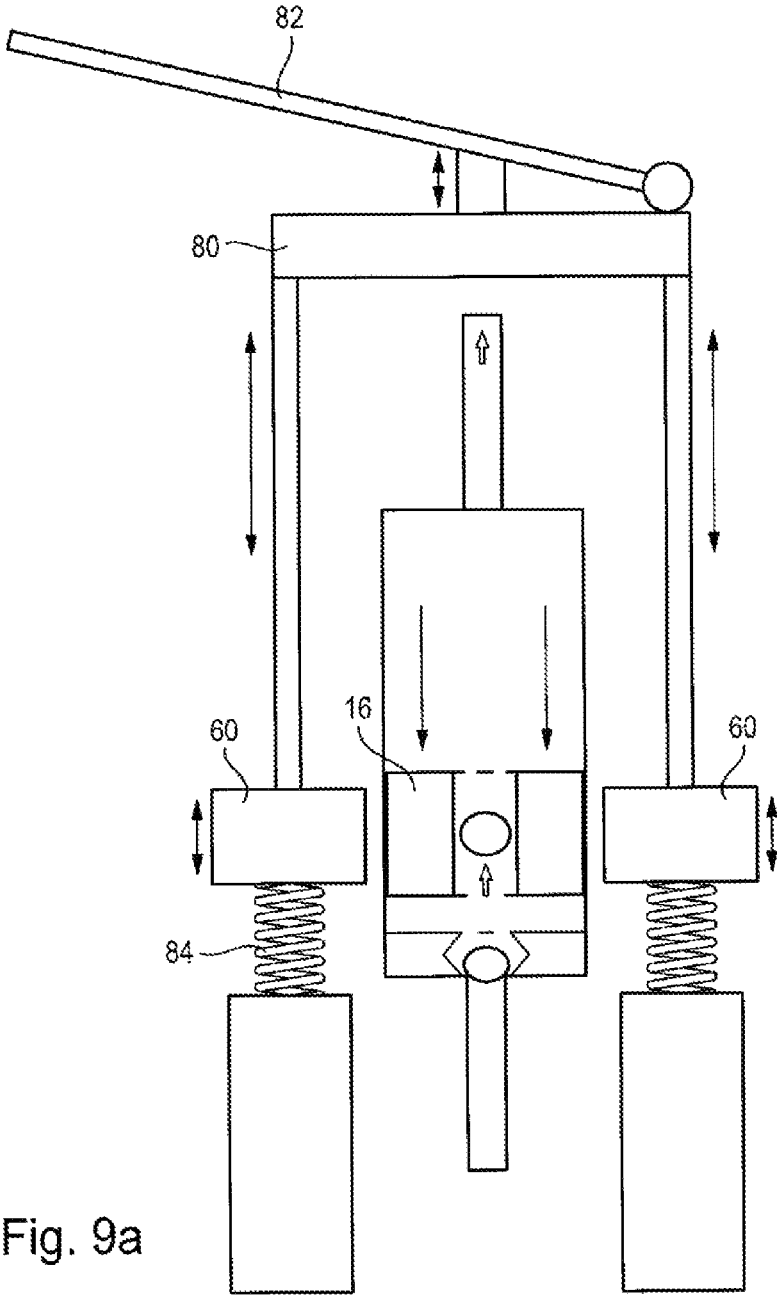
FIG. 9 shows a further alternative to FIGS. 5 and 6.
Figure 9B:
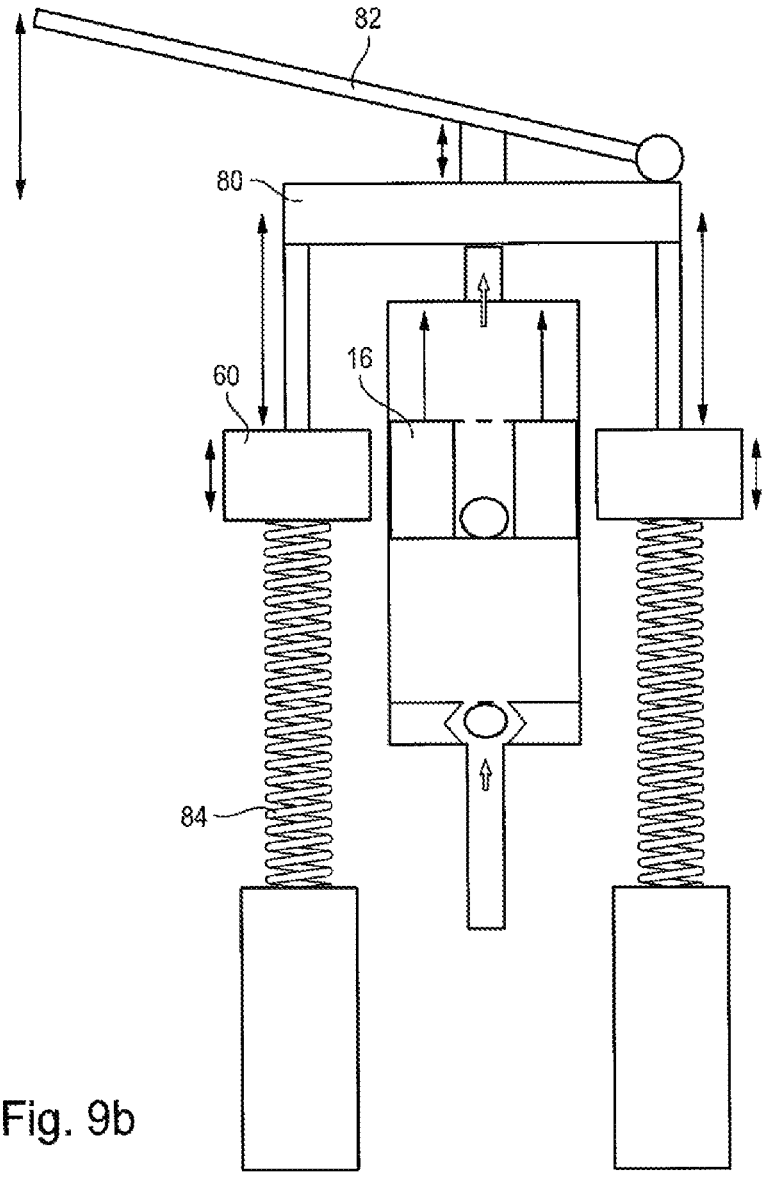

In an embodiment in which the magnetic drive is moved, as is represented in FIGS. 5 and 6, if no electromechanical drive for the permanent magnets 60 is intended to be employed, then also a mechanical drive 80 can be used, which mechanical drive is actuated via a lever 82 that interacts with the switch or sensor 42 and thus realizes a movement of the permanent magnets, at the same time as which a spring 84 is tensioned via the lever 82, cf. FIGS. 9*a* and 9*b*, so that then a restoring force is provided via the spring 84, which restoring force returns the permanent magnet 60, and, via this, also the piston 16, back into the starting position after the conveying process.

The springs 84 can here be tightly, thus fixedly, secured to a holder housing (holder).

Figure 10:
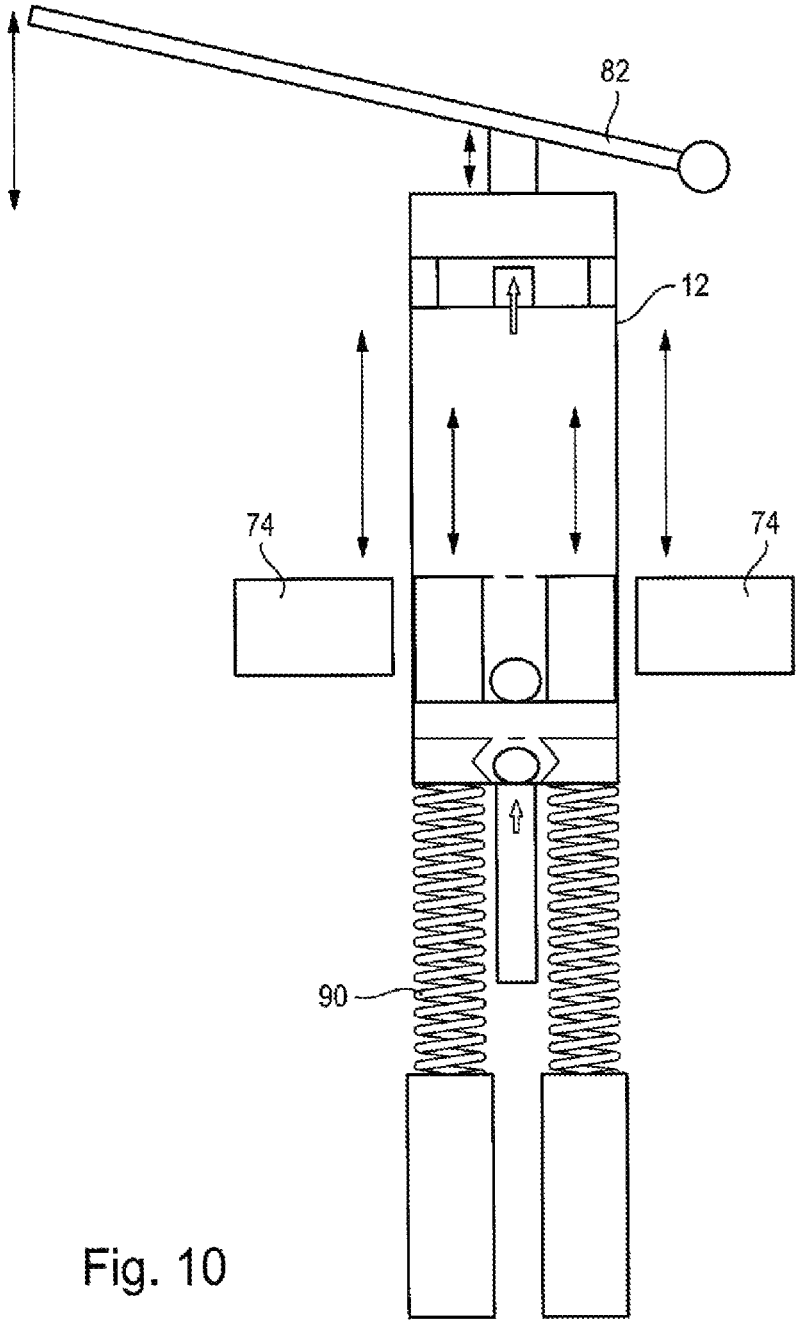
FIGS. 10 and 11 show an alternative to FIGS. 7 and 8.
Figure 11:
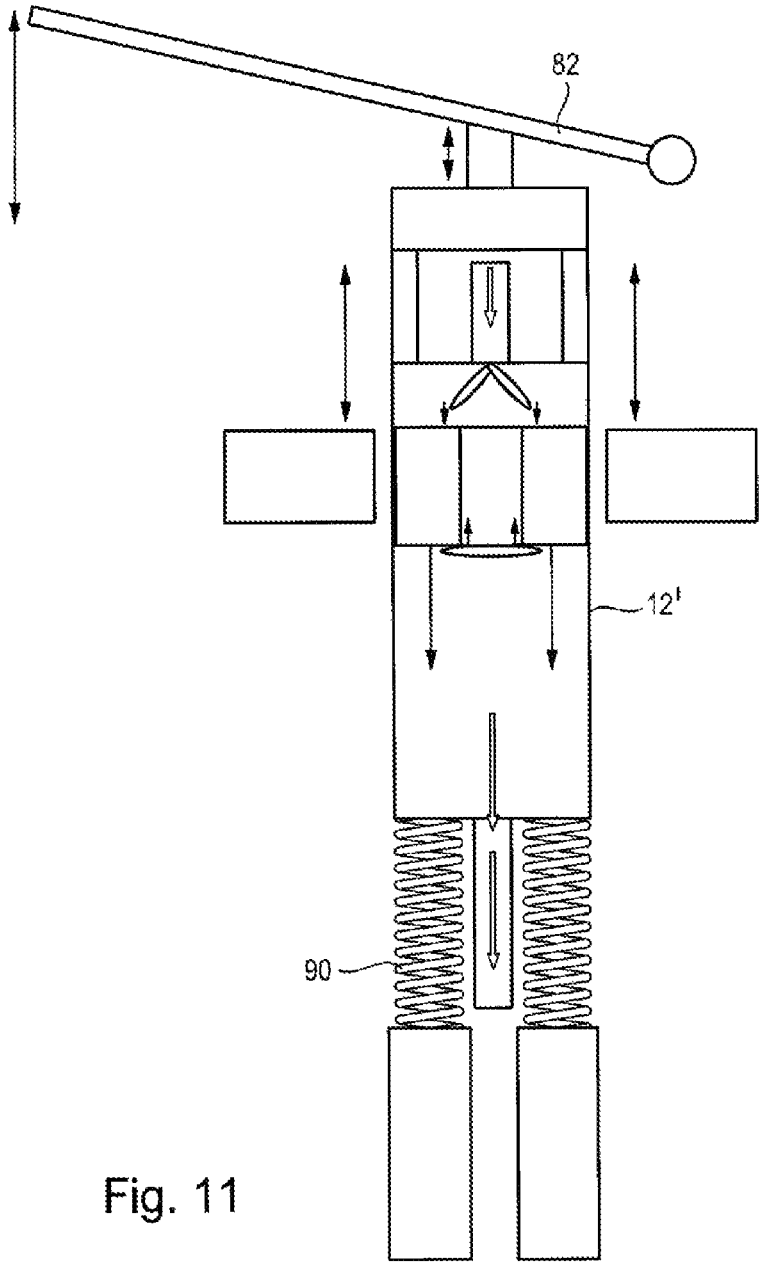

It is likewise possible to provide, instead of an electromechanical drive for the fluid-side module 12 or 12' (cf. FIGS. 7 and 8), here too a mechanical drive, which in FIG. 10 is shown for a fluid-side module 12 according to FIG. 1 and in FIG. 11 for a fluid-side module 12' according to FIG. 3. In this case there can also be provided a lever 82, which does not however move the permanent magnets of the dry module, but rather the fluid-side module 12 or 12' which is secured to a holder by means of a spring 90, wherein the springs are tensioned by means of the lever movement and then enable a resetting of the fluid-side module 12 and 12', while the permanent magnets 74 are provided immovably on the dispenser housing. That is to say, here too the chamber 14 moves, while the piston 16 remains secured.

Figure 12:
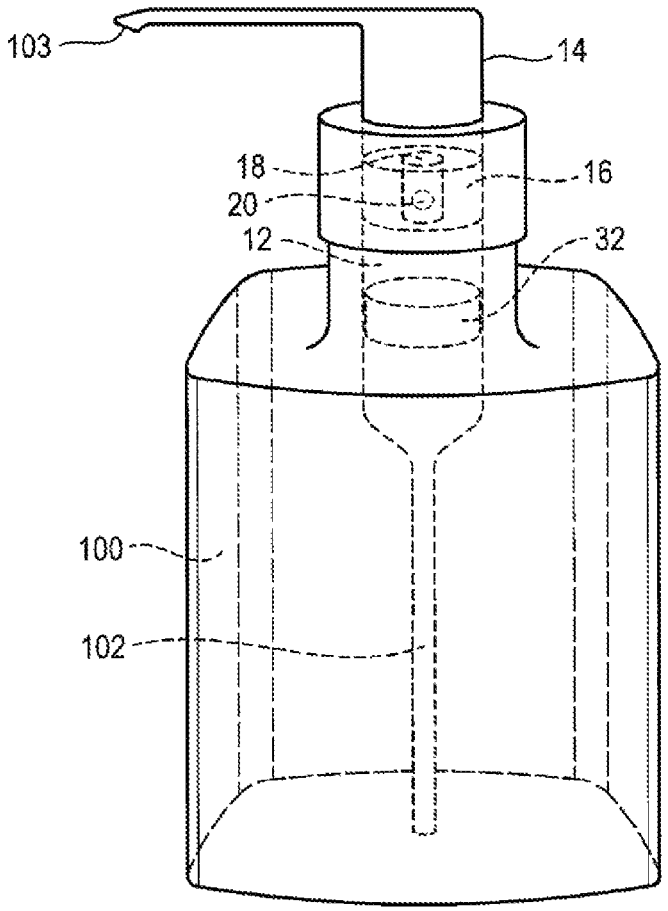
FIG. 12 shows a perspective representation of the invention.

Finally, an embodiment is shown by FIG. 12, wherein the fluid-side module 12 is shown with a fluid reservoir in a system for hand disinfection, and the fluid reservoir 100 is connected to the chamber 14 via a feed line 102. The piston 16 is here moved up and down in the chamber 14 and conveys the fluid out of the fluid reservoir 102 to a dispensing device 103. A corresponding fluid reservoir 100, which can be provided with a fluid-side module 12, is here preferably introduced into an associated fixed holder. The fluid-side module 12 is here constructed as a disposable product, or as a reusable product which is treatable.

In this way, a dosing device can be provided in a particularly simple manner, which dosing device is subjected only to low wear, wherein the susceptibility to faults, which in particular upon contact with alcoholic products, as used for hand disinfection, can be reduced. The preconditions for reliably conveying a prespecified volume throughout the period of use are herewith achieved.

The invention claimed is:

1. A dispenser comprising a dosing device for dispensing of body care products, hygiene products and disinfectants, having a fluid-side module (12, 12') and a dry module (13), wherein the fluid-side module (12, 12') comprises a chamber (14) and a magnetic piston (16) which is guided in the chamber (14) and is moved by means of a moveable magnetic drive in a motional direction of the piston (16), said piston being penetrated by a duct provided with a seal (20, 56), characterized in that the moveable magnetic drive for the magnetic piston (16) is disposed in the dry module (13) and, wherein the moveable magnetic drive comprises magnets (60), which are linearly displaced in the motional direction of the piston (16), and wherein the chamber (14) has an inlet (24) on a side lying in the motional direction of the piston (16) and an outlet (26) on an opposite side, and wherein the inlet (24) is connectable to a fluid reservoir (100), and the outlet (26) to a dispensing device (103).

2. The dispenser of claim 1, wherein the chamber (14) is configured as a riser tube.

3. A method for dosing of body care products, hygiene products or disinfectants, comprising employing the dispenser of claim 1.

4. The dispenser of claim 1 wherein the fluid-side module is designed to be disposable jointly with a fluid reservoir.

* * * * *